US005564488A

United States Patent [19]

Schnakenburg et al.

[11] Patent Number: 5,564,488

[45] Date of Patent: Oct. 15, 1996

[54] HORIZONTAL CONTINUOUS CASTING APPARATUS

[75] Inventors: Joachim V. Schnakenburg, Hillesheim; Franz Keutgen, Lissendorf; Dieter Perings, Büdesheim; Heinz-Josef Leuwer, Lissendorf; Rüdiger Winterhager, Freudenberg; Peter Stadler, Netphen, all of Germany

[73] Assignee: Mannesmann Aktiengesellschaft, Dusseldorf, Germany

[21] Appl. No.: 263,789

[22] Filed: Jun. 22, 1994

[30] Foreign Application Priority Data

Jun. 22, 1993 [DE] Germany ..... 43 21 492.4

[51] Int. Cl.[6] ..... B22D 11/04; B22D 11/10

[52] U.S. Cl. ..... 164/420; 164/440

[58] Field of Search ..... 164/420, 440, 164/490

[56] References Cited

U.S. PATENT DOCUMENTS

| | | | |
|---|---|---|---|
| 2,772,455 | 12/1956 | Easton et al. | 164/420 X |
| 4,739,972 | 4/1988 | Podrini | 164/488 X |
| 5,056,583 | 10/1991 | Morii et al. | 164/488 X |
| 5,348,072 | 9/1994 | Keutgen et al. | 164/420 |

FOREIGN PATENT DOCUMENTS

| | | | |
|---|---|---|---|
| 0077316 | 4/1983 | European Pat. Off. . | |
| 0239919 | 10/1987 | European Pat. Off. . | |
| 1309593 | 10/1962 | France | 164/440 |
| 2453696 | 11/1980 | France . | |
| 2805277 | 8/1979 | Germany | 164/440 |
| 59-19056 | 1/1984 | Japan | 164/440 |

OTHER PUBLICATIONS

Patent Abstracts of Japan; vol. 10 No. 216; Jul. 29, 1986 JP 61–052967 Mar. 15, 1986.

Patent Abstracts of Japan; vol. 8, No. 61, Mar. 23, 1984; JP 58–212848 Dec. 10, 1983.

Patent Abstracts of Japan; vol. 9 No. 235; Sep. 21, 1985; JP 60–92054 May 23, 1985.

*Primary Examiner*—J. Reed Batten, Jr.

*Attorney, Agent, or Firm*—Cohen, Pontani, Lieberman, Pavane

[57] ABSTRACT

The apparatus includes a pouring ladle with a sealable bottom opening and a distributing channel arranged beneath the ladle for the purpose of storing molten metal. The distributing channel is provided with at least two bottom openings that are openable and closable in a controlled manner. A separate tub-shaped basin is arranged beneath each bottom opening of the distributing channel and at least one mold is detachably connected to a bottom portion of each of the tub-shaped basins.

10 Claims, 3 Drawing Sheets

HORIZONTAL CONTINUOUS CASTING APPARATUS

BACKGROUND OF THE INVENTION

1. Field of the Invention

The invention relates to a horizontal continuous casting apparatus, particularly for casting steel.

2. Description of the Prior Art

In horizontal continuous casting apparatuses, especially those for casting steel, the molten metal flows from a ladle into a distributor that is connected to one or more molds.

A horizontal continuous casting apparatus is known from EP 0 077 316 B1 which has a distributing basin to receive the molten metal and at least one open-ended mold attached to the distributing basin. The distributing basin can be moved together with the mold into and out of a position aligned with a stationary strand guideway. Because the mold is attached to the distributing basin, when the mold is changed the distributor must be changed as well, which results in an interruption of production.

A continuous casting apparatus for the horizontal casting and withdrawal of a strand or strands is known from DE 05 25 25 449, which casting apparatus has an antechamber connected to a mold. This antechamber, which is equipped with one or more molds, is connected to a changeover device with which the antechamber can be mounted in a prepositioned location and moved back and forth between the operating position and a reserve position.

Without interfering with the operation of the casting apparatus, an antechamber can be mounted on a bearing table, adjusted and preheated. The antechambers now in use, normally referred to as distributors, receive the molten metal from the ladle and form the connection to the mold. Using the changeover device known from the above-mentioned document, the changeover time of an antechamber (distributor) is shortened, albeit with expensive means; however, every changeover entails an interruption in operation.

SUMMARY OF THE INVENTION

Accordingly, it is an object of the present invention to provide, using simple constructional means, a horizontal continuous casting apparatus for multiple strands, in which it is possible without interrupting production to make a mold change and/or an analysis change in the cast with minimal mixture analysis.

Pursuant to this object, and others which will become apparent hereafter, one aspect of the present invention resides in a horizontal continuous casting apparatus having a distributing channel arranged beneath the pouring ladle for the purpose of storing molten metal. The distributing channel has two bottom openings that can be opened and closed in a controllable manner. A separate tub-shaped basin is provided beneath each bottom opening of the distributing channel for the purpose of conducting molten metal. Finally, at least one mold is removably attached to a bottom portion of each of the tub-shaped basins.

In conventional continuous casting devices, the distributor performs the function of a storage device as well as that of pressure preadjustment during the flow into the mold through the level of the molten metal. The size of the distributor is determined by the cross-section of the cast, and thus of the casting output, and by the time required for a ladle change. In the suggested continuous-casting conducting and storage device, which consists of a distributing channel and the tub-shaped containers known as feeders, these functions are separated. Here the distributor serves to store the molten metal while the individual feeders perform the function of precompression on the side of gating to the mold. This opens up the possibility of constructing the distributor according to a simple design and, in particular, paying no heed to any particular overall height. The individual feeders connected to the molds have a structural shape which allows the level of the molten metal and thus the inflow precompression to the mold to be precisely maintained at the lowest possible volume of molten metal. As a result it is possible for steelworkers to carry out a format change in individual strands during ongoing operation.

When malfunctions occur in individual strands, these can be blocked off and changed without interfering with the neighboring strands.

Furthermore, it is possible to change the quality of the molten metal while experiencing only an extremely slight mixture loss, because what is determinant here is the feeder volume, which is minimized in the apparatus according to the invention. In addition, it is possible to change the distributing channel without an interruption in casting, because while the channel is changed, the feeders are occupied with molten metal. The simple distributing channel with its low structural volume can be exchanged for a new prepared channel both quickly and simply.

In the mold/distributing basin connection, stresses develop in the sides of the basin, because the molds are rigidly attached and in conventional machines the individual mold connections to the distributing channels, which receive a high volume of liquid steel and thus a high heat volume, are usually located far apart from one another. In the present invention due to the independent basins which have a low volume, this problem can be overcome.

The various features of novelty which characterize the invention are pointed out with particularity in the claims annexed to and forming a part of the disclosure. For a better understanding of the invention, its operating advantages, and specific object attained by its use, reference should be had to the drawing and descriptive matter in which there are illustrated and described preferred embodiments of the invention.

DETAILED DESCRIPTION OF THE PREFERRED EMBODIMENTS

Figure 1:
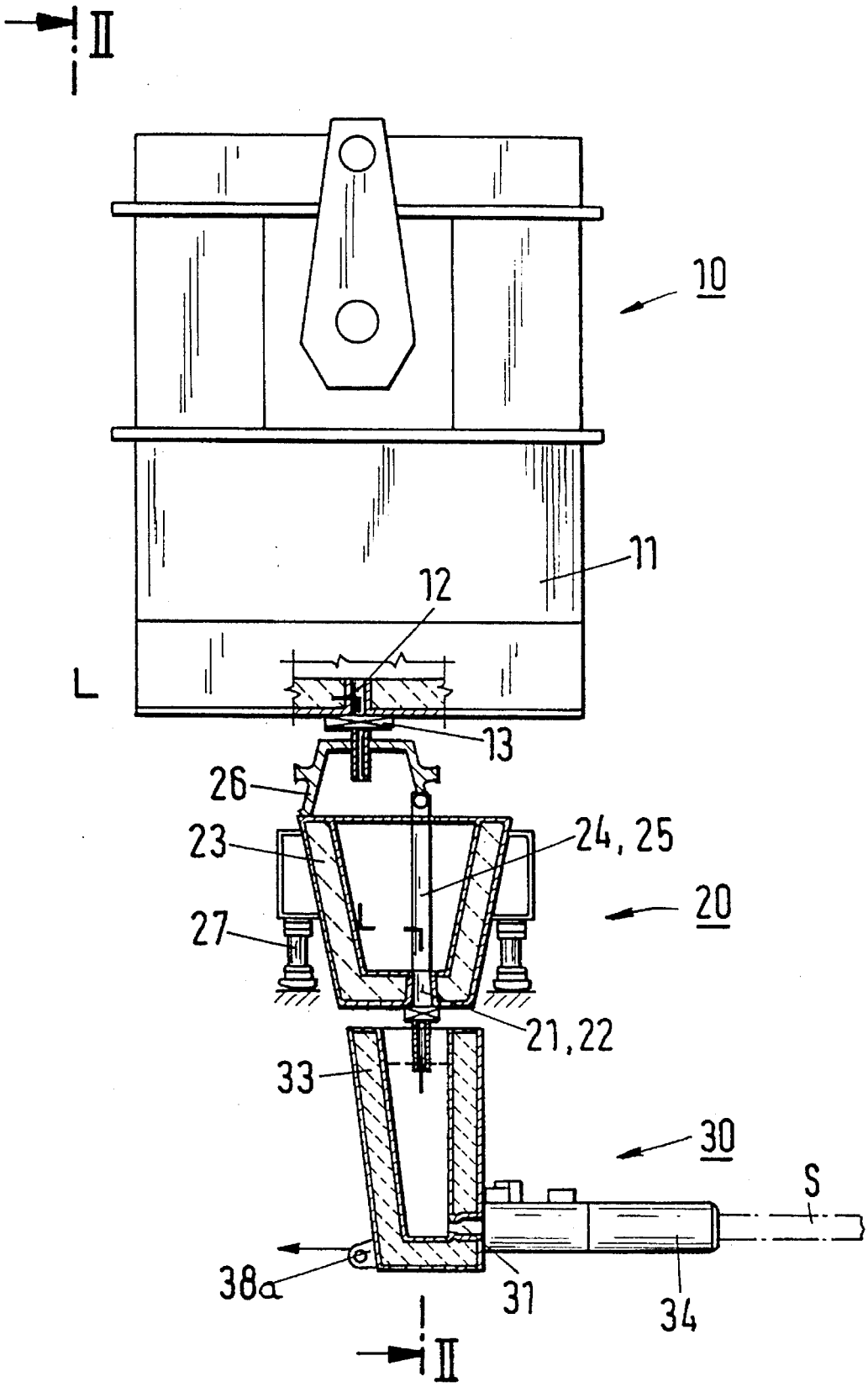
FIG. 1 shows a cross-sectional view of the casting apparatus of the present invention along the line 1—1 in FIG. 2.
Figure 2:
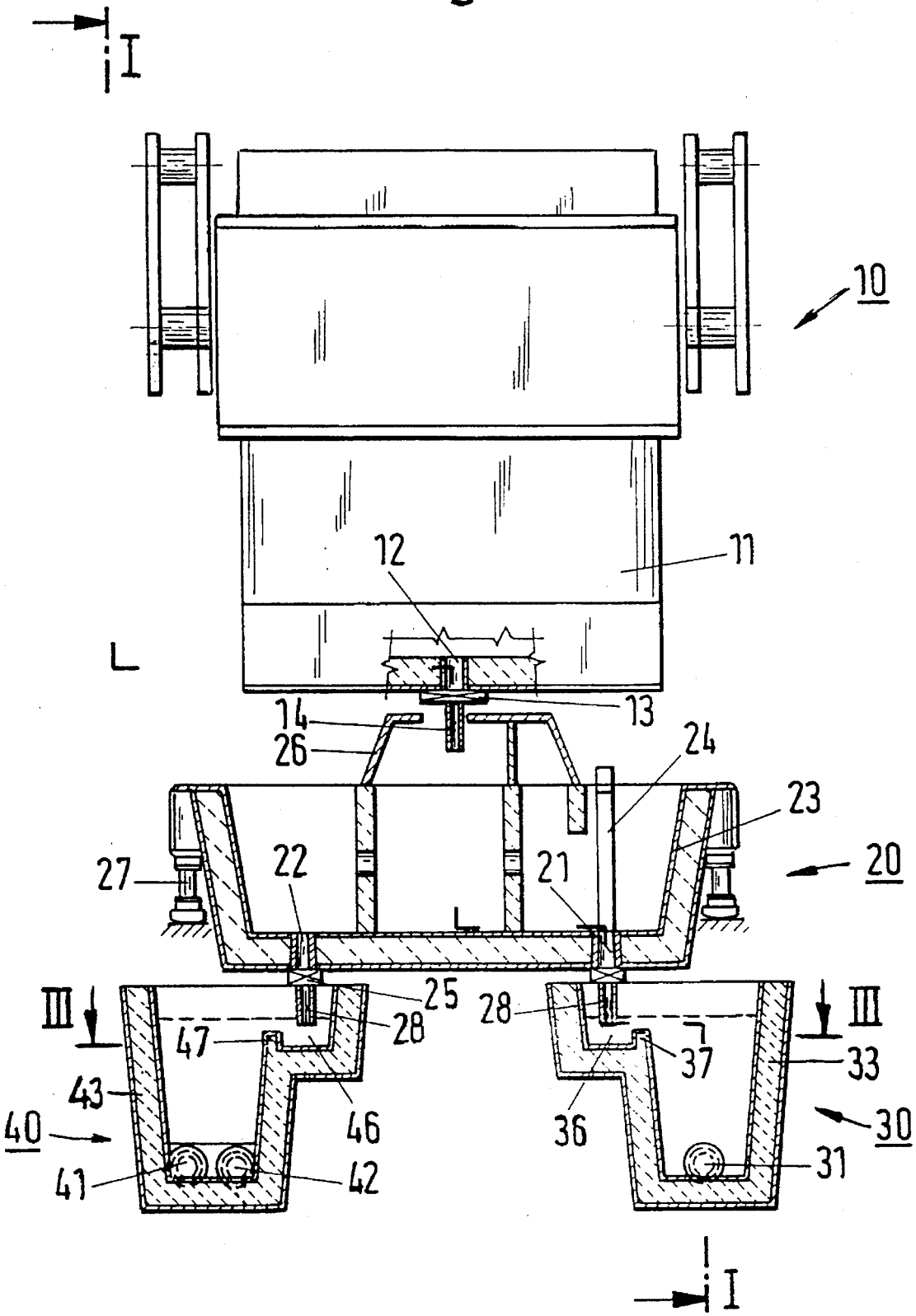
FIG. 2 shows a cross-sectional view along the line II—II in FIG. 1.

FIGS. 1 and 2 show a pouring ladle 10 with a pouring ladle basin 11, which has a bottom opening 12 that can be opened and closed by a stopper 13.

Below the pouring ladle 10, a melting and storage basin 20 is provided that is constructed as a distributing channel 23 and has bottom openings 21, 22. These bottom openings 21, 22 can be closed by stopper devices 24, 25, respectively, which can have different designs.

Lifting devices 27, such as piston/cylinder units, are provided on the sides of the distributing channel 23 for adjusting the vertical position of the distributing channel 23.

The intake area of the distributing channel 23 is protected by a cap 26, which has an opening into which an immersion pipe 14 of the pouring ladle 10 extends.

The bottom openings 21, 22 of the distributing channel 23 are protected by immersion pipes 28 which extend into the tub-shaped containers 30, 40. The tub-shaped containers 30, 40 have feeder basins 33, 43 which possess nozzles 31, 41, 42 in the bottom area of the feeder basins 33, 43.

In the intake area of the feeder basins 33, 43 there are intake basins 36, 46, which are separated by a weir 37, 47 from the main feeder basin 33, 43 of the tub-shaped container 30, 40. The weir 37, 47 has a height between ⅓ and ½ the height of the sidewall of the intake basin 36, 46. The tub-shaped basins are constructed to receive a volume of molten metal equal to an n-th part of a volumetric capacity of the distributing channel, n corresponding to the number of molds.

On the feeder basin 33 an eyelet 38*a* is shown, to which a changeover device that is not described further can be attached. The strand 5, which exits the mold 34 horizontally, is also indicated.

Figure 3:
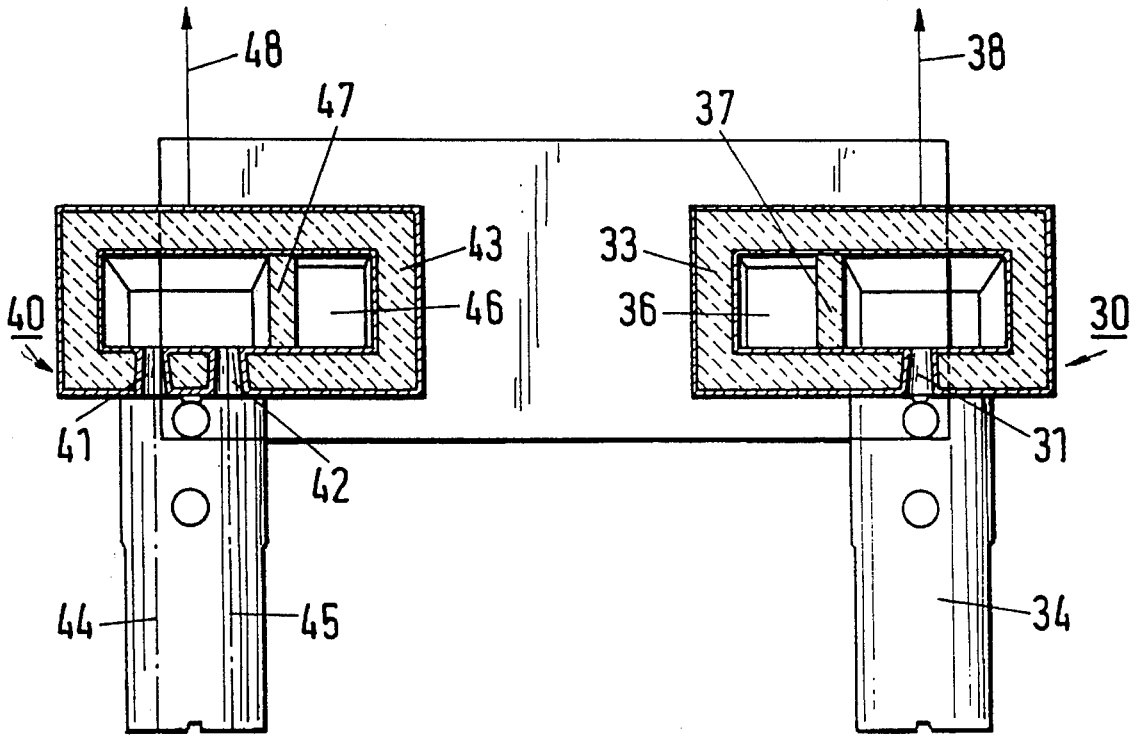
FIG. 3 is a view of the feeders along the line III—III in FIG. 2.

FIG. 3 shows the top view of the container 30, 40 with the feeder basins 33, 43 and the intake basins 36, 46 as well as the weirs 37, 47.

Molten liquid material can be passed through the nozzle 31 of the feeder basin 33 into the mold 34. In the example shown, the feeder basin 43 has the nozzles 41 and 42 via which the liquid material can be passed into the molds 44 and 45.

Changeover devices 38, 48, which are not depicted further, can be attached to the feeder basins 33, 43.

The invention is not limited by the embodiments described above which are presented as examples only but can be modified in various ways within the scope of protection defined by the appended patent claims.

We claim:

1. A horizontal continuous casting apparatus, comprising: a pouring ladle with a sealable bottom opening; at least two horizontally disposed molds; a distributing channel arranged beneath the ladle for storing molten metal and having at least two bottom openings; means for controllably sealing the bottom openings in the distributing channel; tub-shaped basins for conducting molten metal, said tub-shaped basins being constructed to precisely maintain the level of the molten metal and the inflow pressure to said molds at the lowest possible volume of molten metal for permitting a change of the quality of the molten metal with minimum mixture loss during production, one of the tub-shaped basins being arranged in a direction of metal flow, beneath each bottom opening of the distributing channel; and means for detachably attaching at least one of the molds to a bottom portion of each of the tub-shaped basins.

2. A casting apparatus as defined in claim 1, and further comprising means for lifting the distributing channel to adjust its vertical position.

3. A casting apparatus as defined in claim 1, wherein the tub-shaped basins are constructed to be able to receive a volume of molten metal equal to an n-th part of a volumetric capacity of the distributing channel, n corresponding to the number of molds.

4. A casting apparatus as defined in claim 3, wherein each of the tub-shaped basins has an intake basin portion that is positionable below one of the bottom openings of the distributing channel.

5. A casting apparatus as defined in claim 3, wherein each basin has a tub-portion and an intake basin portion, and further comprising a weir located between the intake basin portion and the tub portion of each basin and having a height equal to between one-third and one-half of a remaining side wall of the intake basin portion.

6. A casting apparatus as defined in claim 3, and further comprising means for moving the molds and the basins connected thereto to and fro with respect to an operating position, the moving means being connectable to one of the tub-shaped basins and the molds connected thereto.

7. A casting apparatus as defined in claim 6, wherein an eyelet is arranged on each basin so as to permit connection of the moving means.

8. A casting apparatus as defined in claim 4, and further comprising pipes provided so as to extend from the bottom openings of the distributing channel into the tub-shaped basins.

9. A casting apparatus as defined in claim 1, and further comprising a cap arranged on the distributing channel.

10. A casting apparatus as defined in claim 1, and further comprising at least one nozzle provided at a bottom portion of each tub-shaped basin.

* * * * *